United States Patent [19]

Yaroshevsky et al.

[11] 4,389,244

[45] Jun. 21, 1983

[54] METHOD OF SUPPLYING PULVERIZED FUEL MIXTURE TO BLAST FURNACE TUYERES

[76] Inventors: Stanislav L. Yaroshevsky, ulitsa Schorsa, 25, kv. 6; Leonid F. Lukyanchenko, ulitsa 50-letia SSSR, 108, kv. 172; Grigory N. Sidorenko, ulitsa Artekovskaya, 9; Evgeny N. Skladanovsky, ulitsa 50-letia SSSR, 108, kv. 40; Mikhail A. Zalevsky, ulitsa Kuibysheva, 61, kv. 17; Viktor I. Machikin, ulitsa Kuibysheva, 2, kv. 87, all of Donetsk; Jury G. Bannikov, ulitsa Lenina, 64, kv. 47, Kharkov; Anatoly I. Ryabenko, ulitsa Prozhektornaya, 18, kv. 30, Donetsk; Shamil T. Okazov, ulitsa Schorsa, 6, kv. 25, Donetsk; Vasily V. Stepanov, bulvar Shevchenko, 6, kv. 24, Donetsk; Evgeny A. Danilin, ulitsa Petrozavodskaya, 95, kv. 10, Kharkov; Anatoly A. Yarmal, bulvar Shkolny, 18, kv. 61, Donetsk; Grigory E. Nekhaev, ulitsa Zhabeleva, 26, Donetsk; Jury I. Bat, prospekt Vatutina, 43, kv. 44, Donetsk; Nikolai N. Popov, ulitsa Krymskaya, 7, Donetsk; Alexei M. Kamardin, bulvar Pushkina, 95, kv. 25, Donetsk; Valdimir P. Tereschenko, bulvar Shevchenko, 10, kv. 55, Donetsk; Romualda S. Stankevich, ulitsa Bogomoltsa, 7/14, kv. 156, Kiev, all of U.S.S.R.

[21] Appl. No.: 342,004

[22] PCT Filed: Dec. 25, 1980

[86] PCT No.: PCT/SU80/00218

§ 371 Date: Jan. 11, 1982

§ 102(e) Date: Jan. 11, 1982

[87] PCT Pub. No.: WO81/03341

PCT Pub. Date: Nov. 26, 1981

[51] Int. Cl.[3] ..... C21B 5/00

[52] U.S. Cl. ..... 75/42; 266/182; 266/47

[58] Field of Search ..... 75/41, 42; 266/182, 266/47

[56] References Cited

U.S. PATENT DOCUMENTS 3,167,421 1/1965 Pfeiffer et al. ..... 75/42

3,689,045 9/1972 Coulter et al. ..... 75/42

FOREIGN PATENT DOCUMENTS 147952 4/1981 German Democratic Rep. .... 75/42

*Primary Examiner*—M. J. Andrews

*Attorney, Agent, or Firm*—Burgess, Ryan & Wayne

[57] ABSTRACT

A method of supplying a pulverized fuel mixture to blast furnace tuyeres comprises batch loading the pulverized fuel mixture into a discharging chamber 8 being under gauge pressure, and subsequent continuous distributing thereof from this chamber, and transportation along pipelines 15 to the blast furnace tuyeres by means of gas. According to the invention, after distributing the pulverized fuel mixture from the discharging chamber 8, a supplementary gas is introduced into each pipeline 15, the total flow rate of said gas exceeding that of the main gas 3 to 10 times, and the product of the total flow rate of gas within each pipelines 15 by concentration of the fuel mixture therewithin being maintained equal for all the tuyeres 16.

4 Claims, 1 Drawing Figure

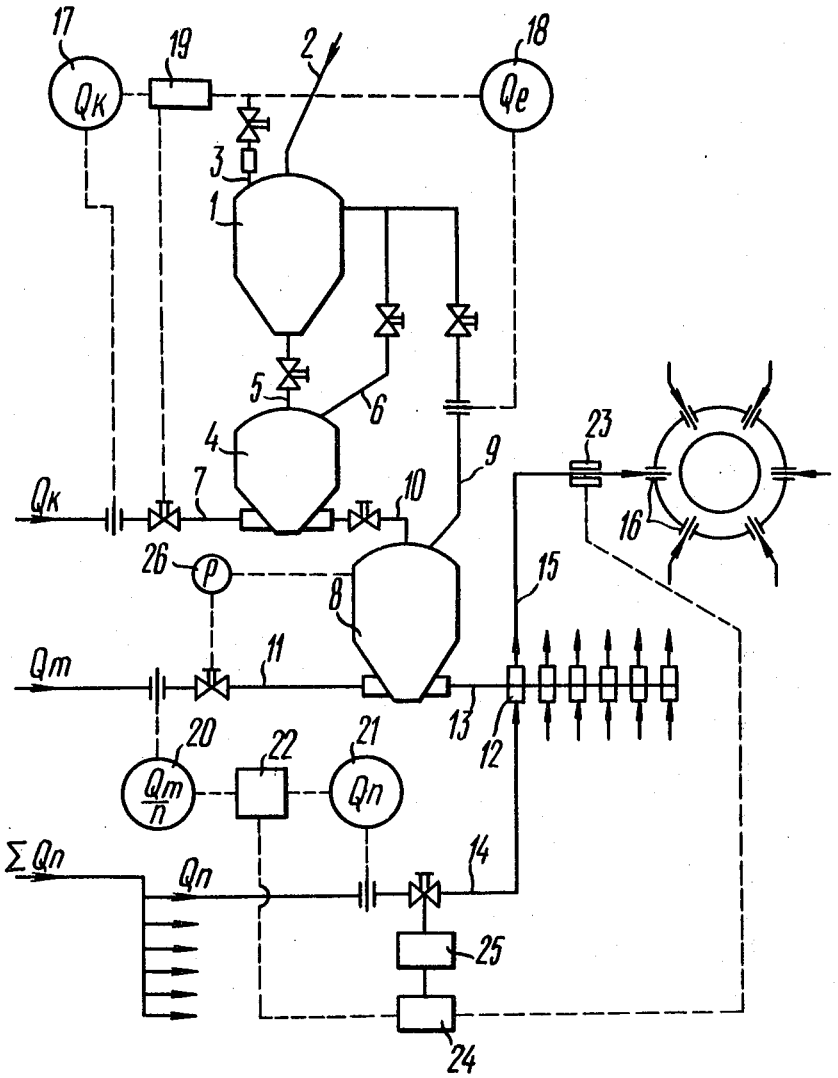
17
19
2
18
Qк
Qe
3
1
5
6
4
9
23
Qк
7
10
16
26
P
15
8
Qm
11
13
12
20
22
21
Qm/n
Qn
Σ Qn
Qn
14
25
24

METHOD OF SUPPLYING PULVERIZED FUEL MIXTURE TO BLAST FURNACE TUYERES

TECHNICAL FIELD

The invention relates to ferrous metallurgy, and more particularly, to a method of supplying a pulverized fuel mixture to blast furnace tuyeres.

The invention is useful in melting pig iron within the blast furnace utilizing injection of coal-dust fuel into the hearth.

BACKGROUND ART

Coking coals are in short supply, that is why one of the most urgent problems of blast furnace production is to replace the coke by fuel mixtures based on noncoking coals, e.g. by coal-dust fuel whose resources are sufficiently large. With utilization of such fuel mixtures, it is especially important to provide for the uniformity of their supply to blast-furnace tuyeres.

Known in the art is a method of supplying coal-dust fuel to blast furnace tuyeres (see N. E. Dunayev et al., Vduvaniye pylevidnykh materialov v domennye pechi, Moscow, "Metallurgiya," 1977, p.p. 96–97), comprising transportation of the above fuel to conical dividers, dividing the fuel flow therewithin into a plurality of flows, the latter being directed along outgoing pipelines to the blast furnace tuyeres.

In the given case fuel is distributed to the tuyeres in a non-uniform manner because the values of hydraulic resistances of drain pipelines are different.

Also known in the art is a method of supplying pulverized fuel mixture, disclosed in the description of operation of the apparatus according to U.S. Pat. No. 3,204,942 and comprising batch loading a discharging chamber with a pulverized fuel mixture and subsequent continuous transportation thereof by means of carrier gas through calibrated openings of a distributor dividing the fuel flow into a plurality of flows, following which said mixture is supplied along outgoing pipelines to blast furnace tuyeres.

It is obvious that utilization of calibrated openings in the given method provides for equalization of the values of hydraulic pressures within the pipelines thereby improving uniformity of fuel distribution to the tuyeres. However, with oscillations of pressure at the blast furnace tuyeres and with wearing or stopping up at least one of the outgoing pipelines, the uniformity of fuel distribution to the tuyeres is upset. The above fact results in formation of conduits within the blast furnace shaft, in deterioration of descent of charge materials, i.e. in upsetting the optimum processing condition of the melting process.

DISCLOSURE OF THE INVENTION

What is required is a method of supplying a pulverized fuel mixture wherein hydrodynamic characteristics of outgoing pipelines are equalized to ensure uniform distribution of fuel to blast furnace tuyeres.

The invention provides a method of supplying a pulverized fuel mixture to blast furnace tuyeres, comprising batch loading the pulverized fuel mixture into a discharging chamber being under gauge pressure, continuous discharging the above mixture from the discharging chamber and transporting it to the blast furnace tuyeres, supplying gas to pipelines, transporting the above fuel mixture along the pipelines by means of said gas, introducing supplementary gas into each pipeline following the discharge of the pulverized fuel mixture from the discharging chamber, the total flow rate of the supplementary gas exceeding that of the main gas 3 to 10 times, the product of the total flow rate of gas in each pipeline by the concentration of the pulverized fuel mixture contained therewithin being maintained constant for all the tuyeres.

The above fact makes it possible to equalize hydrodynamic characteristics of the pipelines, namely to increase hydraulic resistance of each pipeline thereby lowering the effect of changes in counterpressure at the blast furnace tuyeres, and consequently to improving uniformity of fuel distribution to the tuyeres.

The supplementary carrier gas is preferably introduced into the pipeline in the form of a stream directed toward the above fuel mixture leaving the discharging chamber, the speed of the stream of the supplementary gas being maintained within 0.25 to 1.5 times the critical speed of its outflow.

It will also allow the total hydraulic resistance of each pipeline to be increased and the supply of the pulverized fuel mixture to the blast furnace tuyeres will be more uniform.

It is preferred, during the period of loading the discharging chamber, to vent a portion of the main gas therefrom, the flow rate of said gas being equal to that of the gas incoming into the discharging chamber along with the fuel mixture being loaded. This fact will allow the process of distributing the fuel mixture from the discharging chamber to be stabilized thereby also improving the uniformity of distribution thereof to the blast furnace tuyeres.

The invention is further described, by way of example only, with reference to the accompanying drawing in which there is shown a general layout of supplying the pulverized fuel mixture to the blast furnace tuyeres.

BEST MODE FOR CARRYING OUT THE INVENTION

The flow chart practicing the method of the invention is illustrated in the accompanying drawing and includes a storage chamber 1; a pipeline 2 for supplying a fuel mixture to the storage chamber 1; a pipeline 3 for releasing gas from the storage chamber 1, having a filter and a stopping device; a lock chamber 4; a channel 5 connecting the storage chamber 1 with the lock chamber 4; a pipeline 6 for equalizing pressure within the lock chamber 4 and the storage chamber 1; a pipeline 7 for supplying gas into the lock chamber 4; a discharging chamber 8; a pipeline 9 for releasing a portion of gas out from the discharging chamber 8 into the storage chamber 1; a channel 10 connecting the lock chamber 4 with the discharging chamber 8; a pipeline 11 for supplying gas into the discharging chamber 8; feeders-mixers 12; a channel 13 connecting the discharging chamber 8 with the feeders-mixers 12; pipelines 14 for supplying a supplementary carrier gas into the feeders-mixers 12; a pipelines 15 for supplying the fuel mixture to tuyeres 16; an instrument 17 for checking the flow rate $Q_k$ of the gas from the lock chamber 4; an instrument 18 for checking the flow rate $Q_l$ of the gas being released from the discharging chamber 8; a unit 19 for comparing the flow rates $Q_k$ and $Q_l$ and for controlling the flow rate $Q_k$; an instrument 20 for checking the flow rate $(Q_m/n)$ of the gas supplied to the discharging chamber 8 for one pipeline 15 (n is the number of the pipelines 15); an instrument 21 for checking the flow rate $Q_n$ of the supplementary gas per each pipeline 15; a unit 22 for summing up the flow rates ($Q_m$/n and $Q_n$; a concentration meter 23; a unit 24 for multiplying signals of the summing unit 22 and of the concentration meter 23; a unit 25 for comparing signals of the multiplying units 24 of each pipeline and for controlling the flow rate $Q_n$; a regulator 26 of pressure within the discharging chamber 8.

A pulverized fuel mixture is continuously supplied into the blast furnace from the discharging chamber 8 which is batch-loaded with this mixture from the storage chamber 1 via the lock chamber 4. The crushed fuel mixture is loaded into the storage chamber 1 along the pipeline 2 using a pneumatic conveyor or by gravity. The holding capacity of the storage chamber 1 is selected sufficiently large to ensure uninterrupted delivery of the fuel mixture to the blast furnace during at least several hours. At regular intervals, after each 6 to 20 minutes, as the lock chamber 4 becomes empty it is cut off from the pressurized discharging chamber 8, by means of a stopping element provided in the channel 10, and the lock chamber is filled with the fuel mixture supplied from the storage chamber 1. The gas being displaced out of the lock chamber 4 is directed along the pipeline 6 into the storage chamber 1 wherefrom it is released into atmosphere along the pipeline 3 after the gas has been cleaned. After the lock chamber 4 has been filled with the fuel mixture, it is cut off from the storage chamber 1 and is connected with the discharging chamber 8. From the discharging chamber 8, the fuel mixture is supplied along the channel 13 into the feeders-mixers 12 distributing the mixture to individual pipelines 15 and to the tuyeres 16 of the blast furnace.

The uniform distribution of the pulverized fuel mixture to the tuyeres 16 of the blast furnace is accomplished by introducing a supplementary gas into each of the pipelines 15, the total flow rate $\Sigma Q_n$ being equal to (3–10) $Q_m$.

A decrease in the ratio between the flow rates $Q_m$ and $\Sigma Q_n$ more than three times does not allow the differences of hydrodynamic characteristics of the pipelines to be completely compensated, especially in the case of great number and considerable length thereof, and consequently the uniform distribution of fuel to the tuyeres to be ensured. Increasing said ratio above the value of ten, while leading to a slight increase in the uniformity of fuel distribution, is undesirable due to a significant increase in the amount of a cold gas being supplied to the hearth of the blast furnace. The constant consumption of fuel per each tuyere 16 is accomplished by varying the total flow rate of gas within the corresponding pipeline 15. The magnitude of the flow rate $Q_n$ of the supplementary gas per each pipeline 15 is determined considering the condition that the product $\pi$ of the total flow rate of gas within each flow by the concentration of fuel therewithin is to be equal for all the tuyeres, i.e. the value $$\pi_{(i)}=[(Q_m/n)+Q_n]\sigma \qquad \text{(i)},$$

where $Q_m$ is the flow rate of gas supplied into the discharging chamber 8;

n is the number of the pipelines of the tuyeres being fed from the chamber 8;

$Q_n$ is the flow rate of the supplementary gas per i-th tuyere;

$\sigma_{(i)}$ is the fuel concentration within the pipeline of the i-th tuyere, is to be maintained equal for all the tuyeres through changing the value $Q_n$.

Equality of the value $\pi_{(i)}$ for all the tuyeres is expedient to be maintained automatically. For this purpose a signal being proportional to the value ($Q_m$/n) and generated by the instrument 20, and a signal being proportional to the value $Q_n$ and generated by the instrument 21 are fed to the summing unit 22 and then to the multiplying unit 24, whereto there is also fed a signal proportional to the concentration $\sigma_{(i)}$ of the fuel mixture in the pipeline being measured by the concentration meter 23.

The resulting signal of the multiplying unit 24 is compared, in the comparing unit 25, against similar signals fed from other pipelines and, if necessary, there is produced a command either for increasing or for decreasing the flow rate of the supplementary gas depending on a sign of mismatching of the output signal of the unit 25. The minimum product $\pi_{(i)}$ is taken as the standard value for comparing (for the pipeline possessing the maximum resistance) with on coming and side supply of the supplementary gas, while the maximum product $\pi_{(i)}$ (for the pipeline possessing the minimum resistance) is taken in the case of concurrent supply of the supplementary gas ensuring the ejecting effect.

The supplementary gas is preferably introduced into each pipeline 15 in the form of a stream directed toward the fuel mixture leaving the discharging chamber 8. The speed of this gas stream is maintained within the range of 0.25 to 1.5 of the critical discharge velocity thereof. This fact will allow the pressure within a corresponding feeder-mixer 12 to be increased, and the total hydraulic resistance of the pipeline 15 to be correspondingly increased, said resistance becoming higher than values of pressure variations within the tuyere zone of the furnace, thus the variations of pressure within the tuyere zone of the furnace practically do not exert any influence upon the variation of the total resistance of the pipeline 15 thereby providing for uniform supply of fuel.

Decreasing the speed of stream of the supplementary gas below the value of 0.25 of its critical discharge velocity does not result in desirable effect since dynamic pressure thereof is small, and the increase in pressure within the feeder-mixer 12 is insignificant. Increasing the speed of stream of the carrier gas above 1.5 of its critical discharge velocity, while resulting in increasing pressure within the feeder-mixer 12, is undesirable due to increased consumption of energy required for transportation of the fuel mixture, and because of an increase in the capacity of blasting means.

The uniformity of distribution of the fuel mixture and its uninterrupted blasting into the blast furnace depend to a considerable degree on the stability of loading the pressurized discharging chamber 8. In the process of loading the pressurized discharging chamber 8 with the pulverized fuel mixture, particularly with coal-dust material, within the lock chamber 4 there occurs, as a rule, "mushrooming" of the material. As a result, the process of filling the discharging chamber 8 with the pulverized fuel mixture proceeds in unstable manner, and its duration reaches 10 to 15 minutes. To avoid the above undesirable phenomena, it is preferred in the process of loading the discharging chamber 8 to release a portion of gas therefrom, with the flow rate of this gas being equal to that supplied into this chamber along with the fuel mixture being loaded. To this end, in opening the stopping element of the channel 10, there is simultaneously turned on supply of dried air or nitrogen gas into the locking chamber 4 along the pipeline 7, and release of the same amount of gas out of the discharging chamber 8 along the pipeline 9 into the storage chamber 1 and thence along the pipeline 3 and through the filter into the ambient atmosphere. Only the equality between the flow rate of gas supplied into the lock chamber 4 and that of gas released out of the discharging chamber 8 makes it possible to accomplish batch loading thereof with the fuel mixture and simultaneous continuous distributing said mixture therefrom without affecting the pneumatic transportation conditions. The equality of the above flow rates is expedient to be maintained automatically. For this purpose, signals of the instruments 17 and 18 which measure the values of the flow rates $Q_k$ and $Q_l$, are fed into the unit 19 for comparing which unit produces, in the case of a difference between the signals, a command for changing the flow rate $Q_l$ of gas by means of effecting the cutting off and regulating device mounted in the pipeline 7. The position of the cutting off and regulating device in the pipeline 9 is adjusted, as a rule, preliminarily, and is not subject to further adjustments. This is caused by the fact that in order to maintain the loading time constant while increasing the working pressure P within the discharging chamber 8, the magnitude $Q_l$ is to be also increased. The degree of this increase is set automatically since with the position of the cutting off and regulating device being unchanged, the magnitude of the flow rate $Q_k$ of gas released from the pipeline 9 increases proportionally to the magnitude $\sqrt{p}$, where p is the value of gauge pressure within the chamber 8. Accordingly, the value $Q_l$ also increases.

The magnitude of pressure p within the discharging chamber 8 presents the main parameter determining the discharge of the fuel mixture from the chamber 8 into the blast furnace and is set up depending on the required value of this flow rate, gas pressure within the blast furnace tuyeres, and resistance of the pipelines. The total consumption of the fuel mixture is checked in accordance with a change in the mass of the chamber 8 which is measured by means of strain gages in accordance with conventional layouts. The constancy of the value P is maintained by the pressure regulator 26 by means of effecting the cutting off and regulating device of the pipeline 11.

The invention will now be described by the following illustrative Examples.

EXAMPLE 1

The method was carried out on an experimental installation for blasting the coal-dust fuel into the blast furnace having a volume of 1033 $m^3$.

The pressure within the blast furnace was of $20.10^4$ Pa. The pressure within the discharging chamber was of $25.10^4$ Pa. Pressure variation at the blast furnace tuyeres was within $\pm 2.10^4$ Pa. The length of each pipeline measured from the feeder-mixer to the tuyere, was of 100 m, the pipeline diameter being of 25 mm, hydraulic pressure was of $2.5.10^4$ Pa, fuel concentration therewithin, $\sigma_{(i)}$, was of 0.06 $m^3/m^3$.

Filling the lock chamber 4 (see the drawing) having a capacity of 2 $m^3$ with dust-coal fuel was accomplished under atmospheric pressure. Compressed air was supplied into the lock chamber 4, the flow rate of said air, $Q_k$, being of 120 $m^3$/hr. After pressure within the lock chamber 4 had reached the value of $25.10^4$ Pa, the stopping element of the channel 10 connecting the lock chamber 4 and the discharging chamber 8, was opened. Simultaneously, the valve of the channel 9 connecting the storage chamber 1 and the discharging chamber 8, was opened, and gas was released from the latter also at the flow rate of 120 $m^3$/hr. In so doing, an intensive filling of the discharging chamber 8 with dust-coal fuel took place. The pressure within the discharging chamber 8 remained practically constant since the magnitude of the flow rate of the gas being released was equal to that of the gas being supplied thereto. The above fact made it possible to fill the discharging chamber 8 in 3 to 5 minutes, and to stabilize the pressure and the level of material therewithin.

The flow rate $Q_m$ of gas was maintained equal to 20 $m^3$/hr, while that of the additional gas, $\Sigma Q_n$, was of 160 $m^3$/hr, i.e. eight times higher than $Q_m$. Feeding the supplementary gas to the feeders-mixers 12 was carried out toward the corresponding flow of a gas-fuel mixture at a speed of 200 m/s. The value of hydraulic resistance of the pipelines 15 has raised up to $5.10^4$ Pa and has become considerably higher than pressure variations at the tuyeres 16 of the blast furnace thus allowing the variations of supply of fuel to the tuyeres 16 to be reduced down to 5%.

EXAMPLE 2

Using the same installation, the supplementary gas was supplied in accordance with the proposed method in the direction toward the fuel mixture at a speed of about 300 m/s. Hydraulic resistance at the inlet of the pipeline 15 has increased by $9.5.10^4$ Pa due to an increase in the pressure within the feeder-mixer 12. The degree of nonuniformity of supply of dust-coal fuel under the same values of variations of counterpressure ($2.10^4$ Pa) was of 3.6%.

What we claim is:

1. A process for supplying a pulverized fuel mixture to a plurality of blast furnace tuyeres, comprising the steps of:

batch loading the pulverized fuel mixture into a discharge chamber;

maintaining substantially gauge pressure within said discharge chamber;

discharging said fuel mixture from said discharge chamber into a main carrier gas flowing toward said tuyeres to provide a flow of fluidized pulverized fuel mixture;

dividing said flow into a corresponding plurality of main carrier gas streams, one of said streams flowing to each of said tuyeres; and providing a corresponding plurality of supplementary carrier gas streams; and introducing each of said supplementary carrier gas streams into a corresponding one of said main carrier gas streams to form a corresponding plurality of combined gas streams, the total flow rate of all of said supplementary carrier gas streams being 3 to 10 times the total flow rate of said main carrier gas; and maintaining the product of the total flow rate of each of said combined streams by the concentration of pulverized fuel mixture therein, the same for all of said combined streams.

2. The process according to claim 1, wherein the flow speed of said supplementary carrier gas streams is in the range of 200 to 300 meters per second.

3. The process according to claim 1, comprising the additional step of, during said batch loading step, releasing gas from said discharge chamber at a rate equal to the rate at which gas is supplied to said chamber along with the pulverizing fuel mixture.

4. The process according to claim 2, comprising the additional step of, during said batch loading step, releasing gas from said discharge chamber at a rate equal to the rate at which gas is supplied to said chamber along with the pulverized fuel mixture.

* * * * *